US005312088A

United States Patent [19]

Engel

[11] Patent Number: 5,312,088

[45] Date of Patent: May 17, 1994

[54] SCREW DESIGNS FOR A SCISSORS JACK

[75] Inventor: Darryl L. Engel, LaOtto, Ind.

[73] Assignee: Universal Tool & Stamping Co., Inc., Butler, Ind.

[21] Appl. No.: 64,463

[22] Filed: May 21, 1993

Related U.S. Application Data

[62] Division of Ser. No. 32,096, Mar. 17, 1993.

[51] Int. Cl.[5] ..... B66F 3/12

[52] U.S. Cl. ..... 254/126

[58] Field of Search ..... 254/122, 126, 124

[56] References Cited

U.S. PATENT DOCUMENTS 3,451,655 6/1969 Scott ..... 254/122

3,857,548 12/1974 Takeuchi ..... 254/126

FOREIGN PATENT DOCUMENTS 67285 7/1948 Denmark ..... 254/122

*Primary Examiner*—Robert C. Watson

*Attorney, Agent, or Firm*—Hill, Steadman & Simpson

[57] ABSTRACT

An improved scissors jack which has a lead screw that does not extend beyond the confines of the jack when the jack is in the partially raised position so as to reduce the space required for storing the jack. A hollow member is formed with a slot in which the extension of the threaded screw is received so that the end of the screw can slide in the slot when the jack is in the unloaded position to allow the jack to be raised to a mid height condition for storage. Under use, the extending portion of the screw moves to the end of the slot in the hollow member so as to apply tension to the lead screw to thus raise and lower the jack as the lead screw is rotated.

A modified form of the invention utilizes an extended hollow trunion which prevents the end of the lead screw from extending beyond the confines of the trunion and a further modification provides for pivotally connecting two portions of the lead screw so that the jack can be moved to a stored condition.

3 Claims, 2 Drawing Sheets

SCREW DESIGNS FOR A SCISSORS JACK

This is a division of application Ser. No. 08/032,096 filed Nov. 17, 1993.

BACKGROUND OF THE INVENTION

1. Field of the Invention

This invention relates in general to scissors jacks such as shown, for example, in U.S. Pat. No. 5,064,171 assigned to the assignee of the present application.

2. Description of Related Art

Scissors jacks are raised and lowered by rotating a screw which causes the jack to raise and lower. It is desirable in new cars to store scissor jacks in minimum spaces and in particular it is desirable to store such jacks within the spare tire rim of the vehicle. If a scissors jack is raised to a mid height position, it will generally store in the spare tire rim of a vehicle such as an automobile. However, one end of the screw will extend from the jack and, thus, the entire jack cannot be stored within the spare tire rim.

SUMMARY OF THE INVENTION

The present invention provides improved screw designs for a scissors type jack which allows the jack to be stored within the spare tire rim of a vehicle.

It is an object of the present invention to provide a novel screw for a scissors jack which prevents the end of the screw from extending from the jack when the jack is in the mid height position during storage.

Another object of the invention is to provide a novel screw for a scissors jack wherein a screw is received in a slide so that during storage, one end of the screw can move in the slide so that the end of the screw does not extend from the jack.

Another feature of the invention is to provide an extended hollow trunion which extends into the jack such that the end of the screw will not extend beyond the confines of the jack in the mid height position.

Yet another object of the invention is to provide a pivoted screw for a scissors jack.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

FIGS. 1–4 illustrate the first embodiment of the invention.

Figure 1:
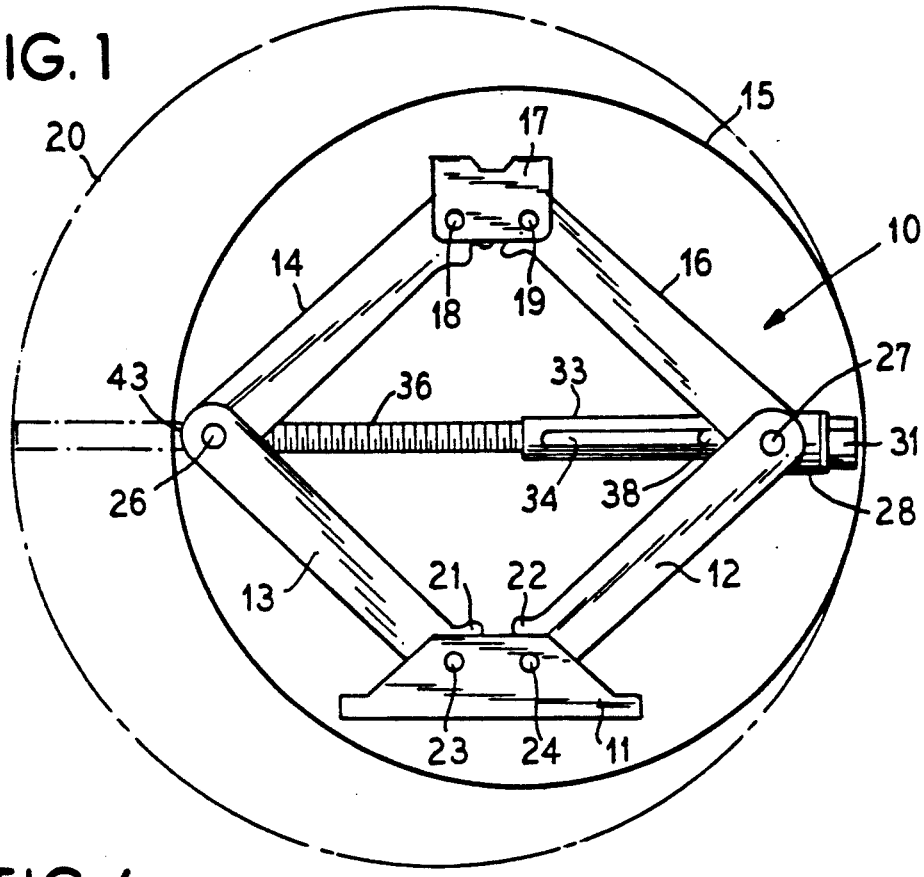
FIG. 1 is a plan view illustrating a scissors jack in the stored position.
Figure 2:
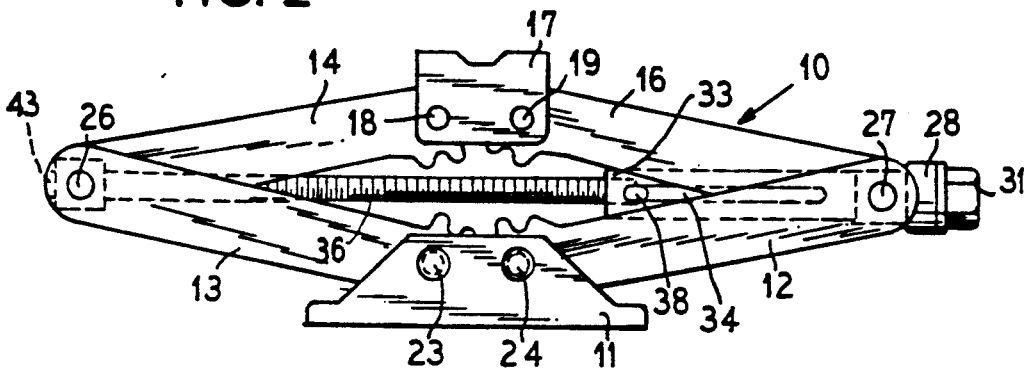
FIG. 2 is a side plan view of the improved jack according to the invention.

As shown in FIGS. 1 and 2, a scissors jack 10 is formed with a base 11 and has lower channel members 12 and 13 which are pivotally connected by pivot pins 24 and 23 to the base 11 and gear teeth 21 and 22 on the channel members 13 and 12 engage so as to operate the jack. The upper end of channel members 12 and 13 are connected by pivot pins 27 and 26 to upper channel members 16 and 14. The upper ends of the channel members 14 and 16 are connected to a support member 17 by pivot pins 18 and 19. The upper ends of the channel members 14 and 16 are provided with gear teeth which mesh.

Figure 3:
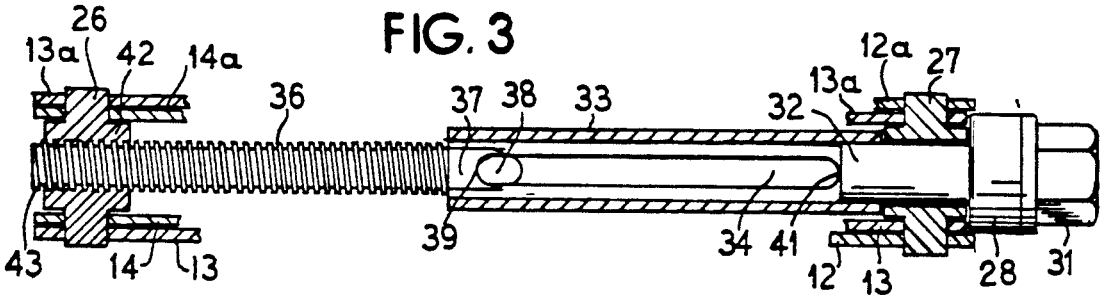
FIG. 3 is a detailed view illustrating a hollow member with a slot that allows the screw to move therein.
Figure 4:
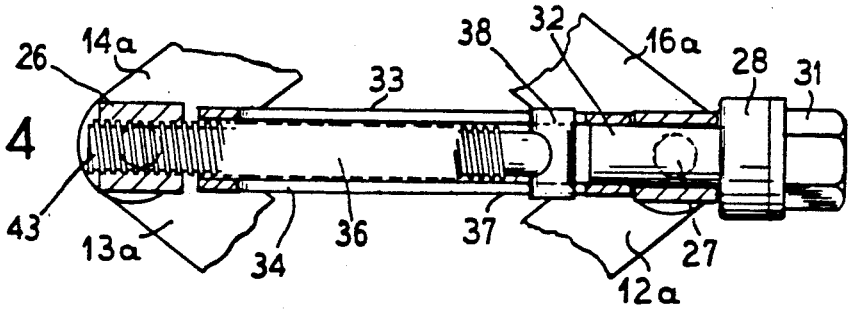
FIG. 4 is a detailed view of the hollow member with a slot with the screw received therein.

The pivot pin 26 is part of a threaded trunion 42 as shown in FIGS. 3 and 4 which has an enlarged portion 42 which is threaded so as to receive a screw 36. The screw 36 has a transverse extension member 38 which extends into a hollow member 33 which is formed with a slot 34 in which the transverse member 38 is received.

The hollow member 33 is connected to a shaft 32 which extends through a trunion 27 which has portions which provide the pivot pin 27 as shown in FIGS. 2, 3 and 4. A bearing 28 is mounted about the shaft 32 between the trunion 27 and a hexagonal head 31 which is connected to the shaft 32 so as to turn it to raise and lower the jack.

In operation, the jack is lowered to the position shown in FIG. 2 and at this point, the end 43 of the screw 36 does not extend substantially beyond the ends of the channel members 13 and 14 as shown in FIG. 2. As the member 31 is rotated to raise the jack, the lead screw 36 will extend to the left relative to the threaded trunion 42, thus raising the jack with the extension 38 in engagement with the end 39 of the slot 34 thus placing the lead screw 36 and hollow member 33 in tension between the trunion 42 and the trunion 27. As the lead screw 36 is rotated to move the trunion 42 toward the trunion 27, the jack will be raised under load. So as to store the jack in the minimum diameter wheel rim 15 as shown in FIG. 1, the jack is lowered to its lowest position substantially as shown in FIG. 2 with end 43 within the confines of the channels 13 and 14 as shown. Then the base and support 17 are pulled apart manually so as to move the jack to the position shown in FIG. 1. As this occurs, the screw 36 slides in the slot 34 of the hollow member 34 so that the extension 38 moves to the right relative to the hollow member 38 to the position shown in FIG. 4. Thus, this allows the jack 10 to be placed in the intermediate height position shown in FIG. 1 without the end 43 of the screw extending beyond the confines of the channels 13 and 14 so that the jack can be stored in the smallest circle 15. The prior art jacks when in the position shown in FIG. 1 have screws which extend so that the jack can only be stored in a circle such as the circle 20 shown in FIG. 20 which is substantially larger than the circuit 15. Thus, the jack of the invention can be stored in a smaller space.

Figure 5:
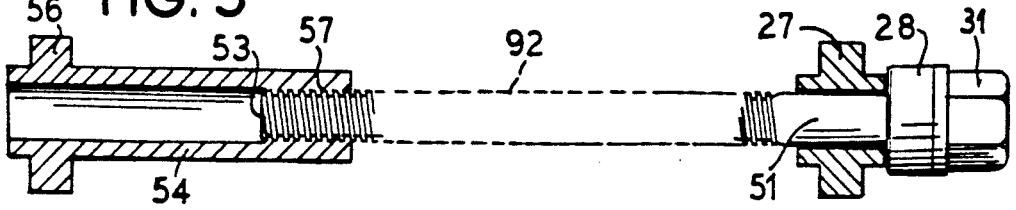
FIG. 5 illustrates a modification of the invention that incorporates an extended hollow trunion.

FIG. 5 illustrates a modified form of the invention wherein the trunion 26 is replaced by an extended hollow trunion 54 which has a pivot pin 56 and which provides the function of the pivot pin and trunion 26 in the first embodiment. End portion 57 of the extended hollow trunion is threaded so as to receive the screw 92 therein. The other end of the screw is connected to a shaft 51 which extends through the trunion 27 and a bearing 28 and is attached to the hexagonal head 31.

In use, since the screw 92 is shorter due to the hollow extended portion of the hollow extended trunion 54, in the full down position of the jack, the end 53 of the screw will be in the position shown in FIG. 5. The jack can be moved to an intermediate height position by rotating the screw 92 so that the end 53 is substantially flush with the left end of the extended hollow trunion 54 at which position the jack will be substantially in the position shown in FIG. 1 at the intermediate height position without the end 53 extending beyond the end of the extended hollow trunion 54 so that the jack can be stored in a minimum space.

Figure 6:
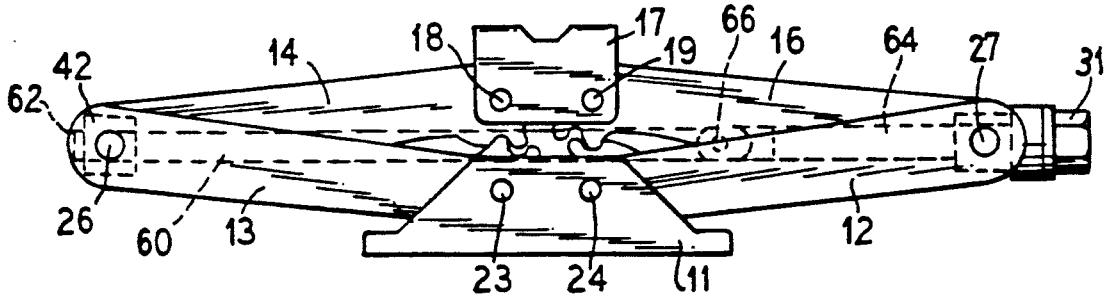
FIG. 6 illustrates a further modification of the invention which has a pivoted screw.
Figure 7:
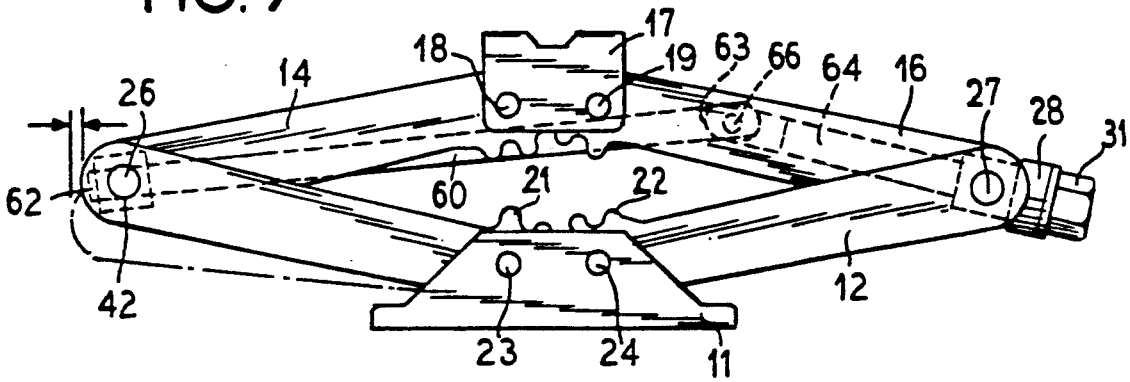
FIG. 7 illustrates the embodiment of FIG. 6 in the partially raised position.

FIGS. 6 and 7 illustrate a further modified form of the invention. The lead screw comprises two portions 60 and 64 which are pivotally connected by a pin 66. FIG. 6 illustrates the lead screw comprising the portions 60 and 64 which are pivoted together by the pivot pin 66 mounted in the jack such that the end 62 of the lead screw portion 60 does not extend beyond the end of the jack. With the jack in this position, the lift member 17 can be separated from the base 11 so as to cause the lead screw portions 60 and 64 to pivot relative to each other about the pivot pin 66 to the position shown in FIG. 7 so as to require a smaller space for storing the jack. The lead screw portion 64 moves up into the confines of the channel member 16 so that the end 63 is within the channel member when the jack is in the position shown in FIG. 7.

It is seen that the present invention provides a new and novel lead screw means so as to reduce the storage space required for scissors jack and although it has been described with respect to preferred embodiments, it is not to be so limited as changes and modifications can be made therein which are within the full intended scope as defined by the appended claims.

I claim as my invention:

1. A scissors jack which can be stored in a minimum diameter of a circular space comprising, a base member, first and second lower channel members pivotally attached to said base member, the lower ends of said first and second lower channel members formed with gear teeth which mesh together, a load supporting cap, first and second upper channel members pivotally attached to said cap, a threaded trunnion formed with pivot pin portions which pivotally connects the upper end of said first lower channel member to the lower end of said first upper channel member, a plain trunnion formed with pivot pin portions which pivotally connects the upper end of said second lower channel member to the lower end of said second upper channel member, a threaded screw with one end threadedly received through said threaded trunnion, a shaft which has a length which terminates between the plain and threaded trunnions and which extends through said plain trunnion and formed with a hollow end portion which extends into the region between said plain trunnion and said threaded trunnion and into which one end of said threaded screw is slidably received, means for limiting the slidable relative motion between said hollow end portion and said threaded screw and for preventing rotational movement between said threaded screw and said hollow end portion so that said jack can be stored in a minimum diameter of a circular space.

2. A scissors jack which can be stored in a minimum space according to claim 1 wherein said means for limiting the slidable relative motion and for preventing rotational movement between said threaded screw and said hollow end portion comprises a longitudinal slot formed in said hollow end portion between said plain and threaded trunnions and a transverse extension attached to the second end of said threaded screw and extending into said longitudinal slot in said hollow end portion between said plain and threaded trunnions.

3. A scissors jack which can be stored in a minimum space according to claim 2 wherein said shaft is formed a portion that is matable with a handle to allow said shaft to be rotated so as to raise and lower the jack.

* * * * *